US006493906B2

(12) United States Patent
Matteau

(10) Patent No.: US 6,493,906 B2
(45) Date of Patent: Dec. 17, 2002

(54) HINGE STRUCTURE

(76) Inventor: Charles Matteau, 1550 des Malards, St. Adele (CA), J8B 2B4

( * ) Notice: Subject to any disclaimer, the term of this patent is extended or adjusted under 35 U.S.C. 154(b) by 0 days.

(21) Appl. No.: 09/776,381

(22) Filed: Feb. 2, 2001

(65) Prior Publication Data

US 2002/0104191 A1 Aug. 8, 2002

(51) Int. Cl.[7] ..... E05D 11/06
(52) U.S. Cl. ..... 16/358; 16/392
(58) Field of Search ..... 16/358, 361, 362, 16/357, 392, 239, 246, 82

(56) References Cited

U.S. PATENT DOCUMENTS

| | | | | | |
|---|---|---|---|---|---|
| 61,766 | A | * | 2/1867 | Schafer | 16/358 |
| 552,485 | A | * | 12/1895 | Rich | 16/358 |
| 1,075,130 | A | * | 7/1913 | Streberger | 16/358 |
| 2,008,257 | A | * | 7/1935 | Lefevre | 16/360 |
| 2,398,017 | A | * | 4/1946 | Lidin | 16/358 |
| 2,435,670 | A | * | 2/1948 | Buehler | 16/358 |
| 2,793,387 | A | * | 5/1957 | Odell | 16/358 |
| 5,169,221 | A | * | 12/1992 | Wheeler | 16/358 |
| 5,172,969 | A | * | 12/1992 | Reuter et al. | 16/358 |
| 5,535,482 | A | * | 7/1996 | Grabber | 16/363 |

* cited by examiner

*Primary Examiner*—Chuck Y. Mah
(74) *Attorney, Agent, or Firm*—Eric Fincham

(57) ABSTRACT

A hinge structure which is invisible from the front of the panel to be opened, the hinge structure comprising a first member which has first and second pins extending upwardly and a second member which has first and second slots to receive the first and second pins respectively, the first slot having an arcuate configuration to permit the first pin to move therein and the second slot having an elongated S-shaped configuration. The use of the two pins enables the door to fully open through greater than 90 degrees.

11 Claims, 6 Drawing Sheets

HINGE STRUCTURE

FIELD OF THE INVENTION

The present invention relates to a hinge structure and more particularly, relates to a hinge structure to permit a door or like member to open, and wherein the hinge structure is out of view when the door is in the closed position.

BACKGROUND OF THE INVENTION

There are many different types of hinges known in the art and such structures have been employed for a number of years in various applications such as in cabinets and the like. When a door is mounted with a hinge such that the pivot point is behind the face of the door/frame assembly in the closed position, the door will not open properly unless there are provided means for displacing the door outwardly. Otherwise, the door will contact the frame structure upon which it is mounted.

There have been many proposals in the art to increase the distance of the door from the frame structure and many different types of hinges have been proposed to accomplish the above. However, most of the proposed hinges employ a number of members and have a relatively complicated structure. The hinges also tend to be relatively large, expensive and can pose some hazard to the ends of the fingers between the various members when opening and closing the door.

SUMMARY OF THE INVENTION

It is therefore an object of the present invention to provide a novel and inexpensive hinge structure which permits the opening of a door which is mounted flush to the frame.

Initially, it will be understood that as used herein, the term "door" is used for convenience and it will be understood the hinge structure will be utilized with any swingable panel. Similar hinge structure may be employed.

According to one aspect of the present invention, there is provided a hinge structure comprising a first member having first and second pins extending upwardly therefrom, a second member, the second member having first and second slots designed to receive the first and second pins respectively, the first slot having an arcuate configuration to permit the first pin to move therein, the second slot having an elongated S-shaped configuration having a first arcuate portion thereof extending in a first direction and a second arcuate portion thereof extending in a second arcuate direction.

As set forth above, the hinge structure includes first and second members. It will be understood that reference herein will be made to each of the members being formed independently and subsequently attached to either the frame structure or the panel which is hingedly attached thereto. However, it will be understood that one may also incorporate the features of the invention into the hingeable panel and the surrounding frame structure—i.e. the pins could be formed in the frame and grooves provided within the panel to replace the slots. In such an arrangement, one set of the pins could be mounted on springs and then released to permit placement of the door. Such an arrangement is an alternative embodiment of the present invention.

There are several different ways of attaching the members to the panel and/or surrounding frame. Thus, the members can either be recessed within the panel and/or frame or alternatively, may be secured thereto in a conventional manner by mechanical fasteners such as screws and the like or alternatively, by adhesive means. Still further, various different shapes may be employed for attaching the member in a desired fashion.

The members, when formed of separate components, may be manufactured of any suitable material such as a plastics material, a metallic material, etc. It suffices to say that normally the material will be chosen for aesthetic purposes.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
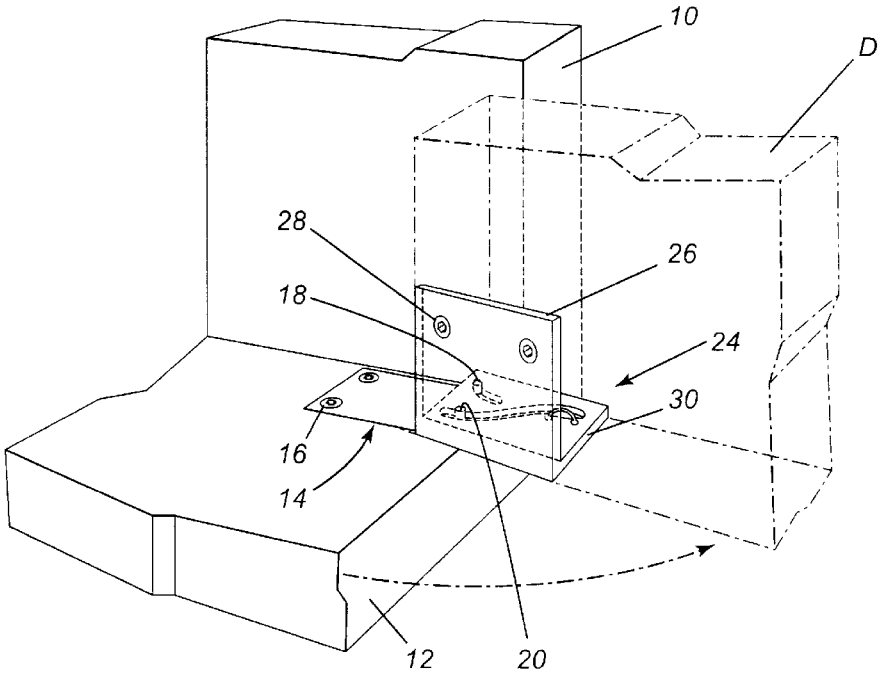
FIG. 1 is a perspective view of a hinge structure according to the present invention mounted on a door.

Referring to the drawings in greater detail and by reference characters thereto, there is illustrated in FIG. 1 a portion of a door D which is mounted in a frame structure including a side frame member 10 and a bottom frame member 12.

The hinge assembly according to the present invention has a first hinge member 14 which, in the illustrated embodiment, comprises a flat plate secured to bottom frame member 12 by means of screws 16. Extending upwardly from first hinge member 14 is a first pin 18 and a second pin 20. In this respect, it will be noted that first pin member 18 is situated closer to side frame member 10 than is second pin 20. However, second pin 20 is situated closer to the opening defined by side frame member 10 and bottom frame member 12.

The hinge assembly also includes a second hinge member generally designated by reference numeral 24 and which is comprised of a vertical portion 26 and a horizontal portion 30. As may be seen in FIG. 1, vertical portion 26 is secured to the inner surface of door D by screws 28 while horizontal portion 30 may be recessed within the bottom wall of door D.

Horizontal portion 30 of second hinge member 24 includes a first slot or channel 32 which has a C-shaped configuration and which is designed to receive first pin 18 of first hinge member 14 and a second slot or channel generally designated by reference numeral 34 and which is designed to receive second pin 20 of first hinge member 14.

Figure 2:
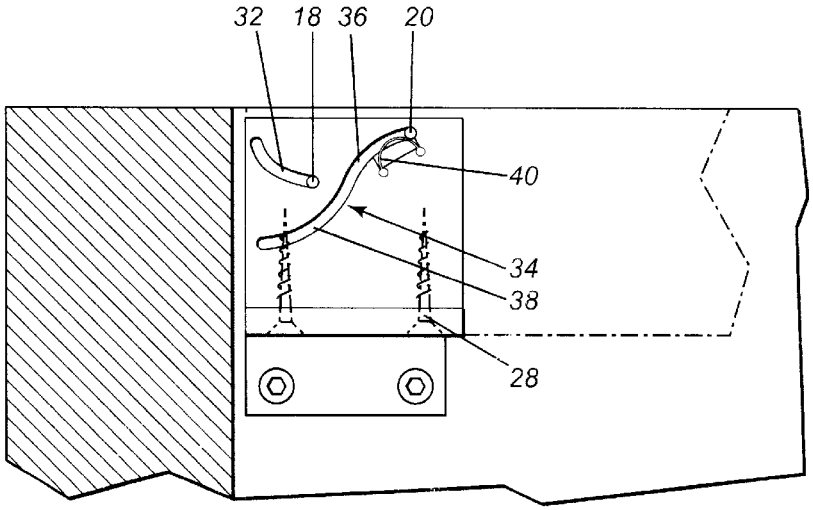
FIG. 2 is a top view thereof, partially in section, of the embodiment of FIG. 1 when the door is in a closed position.

As may be best seen in FIG. 2, second slot or channel 34 has a somewhat elongated S-shaped configuration with a first arcuate portion 36 and a second arcuate portion 38. It will be noted that first arcuate portion 36 extends in a first direction while second arcuate portion 38 extends in an opposite direction.

In the illustrated embodiments, there is provided a flexible spring member 40 which is mounted on horizontal portion 30 of second hinge member 24 near a distal end of first arcuate portion 36 for reasons which will become apparent hereinbelow. It will, of course, be understood that the flexible spring member is optional and that the hinge structure functions without use of the flexible spring member 40.

In use, first hinge member 14 and second hinge member 24 are mounted such that first pin 18 is slidably mounted within first slot 32 while second pin 20 is slidably mounted within second slot 34.

When the door is a closed position, as shown in FIG. 2, first pin 18 is situated within first slot 32 at a first end thereof. Similarly, second pin 20 is situated at a distal end of first arcuate portion 36 where it is retained by means of spring member 40. Thus, spring member 40 acts to retain door D in a closed position.

Figure 3:
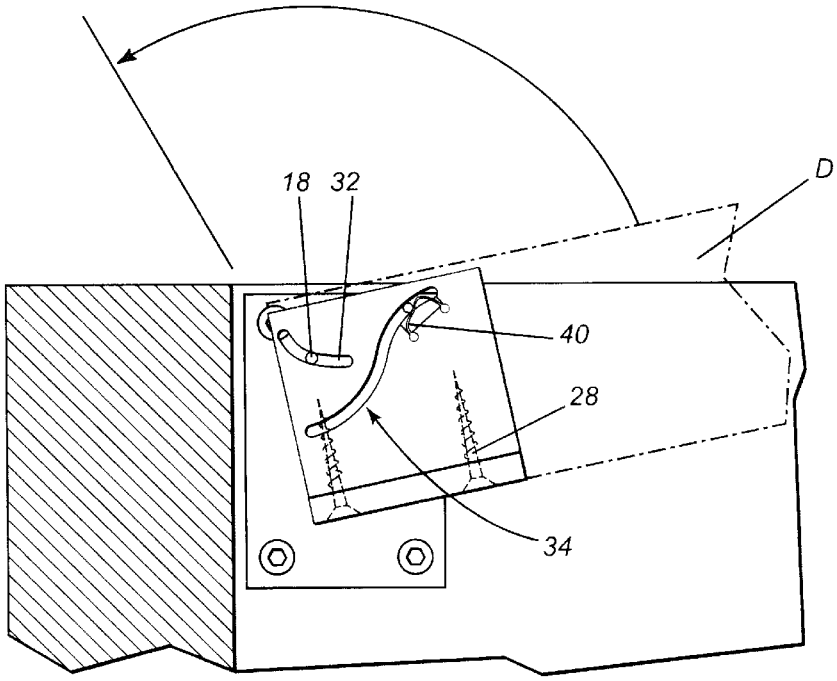
FIGS. 3 and 4 illustrate the embodiment of FIG. 1 showing the opening of the door and the functioning of the hinge.
Figure 4:
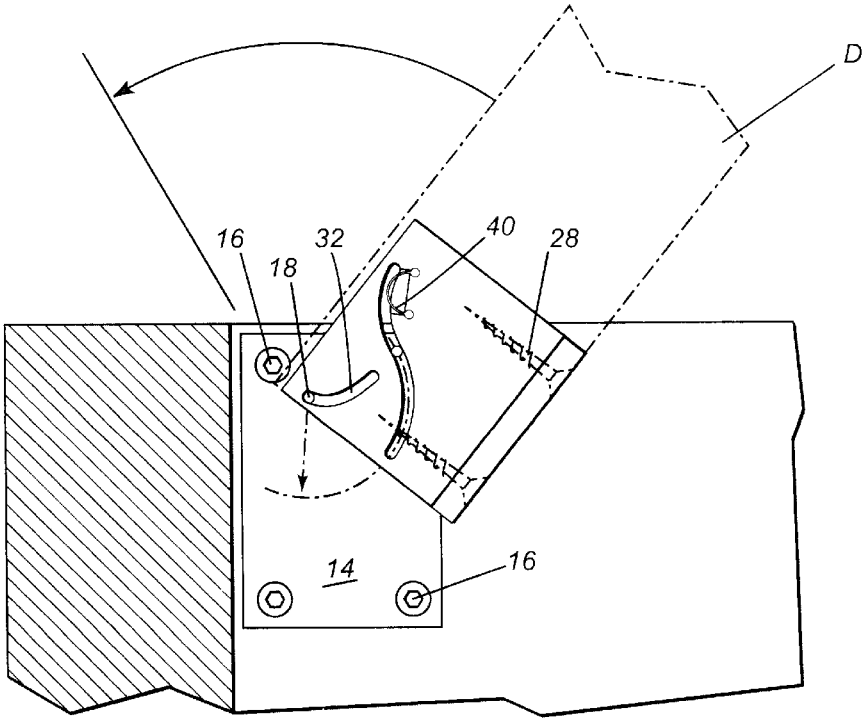

Upon an opening force being exerted on door D sufficient to overcome the force of spring member 40, and as may be seen in FIGS. 3 and 4, when the opening force is exerted on door D, the slots 32 and 34 start to move on pins 18 and 20 respectively. In this respect, first pin 18 acts as a pivot for the hinge while second pin 20 acts as a guide.

By opening the door D, the sliding action of guide 34 shifts the relationship of first slot 32 and first pin 18 to the position shown in FIG. 3. This movement enables the door to clear the surrounding side frame member 10.

Once second pin 20 is positioned between first arcuate portion 36 and second arcuate portion 38, first pin 18 reaches the opposite end of first slot 32. At this point, second arcuate portion 38 is simply an arc to permit door D to open wider once it is clear the surrounding structure. When second pin 20 is positioned at the distal end of second arcuate portion 38, the door is fully open and has rotated greater than 90 degrees—approximately 110 degrees.

The design thus offers a first pivoting point for the door combined with a shifting motion to enable the door to clear the surrounding structure. The action or force to open the door uses the arrangement as a moving fulcrum which provides a smooth motion for the opening and moving the doorway from the surrounding frame structure.

Figure 5:
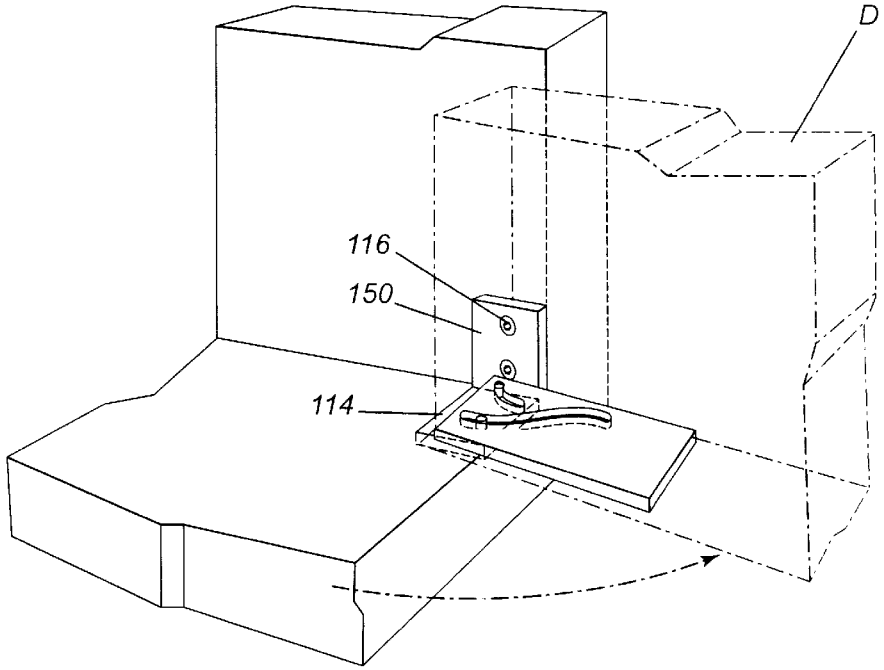
FIG. 5 is a view similar to FIG. 1 of a further embodiment of a hinge structure according to the present invention.
Figure 6:
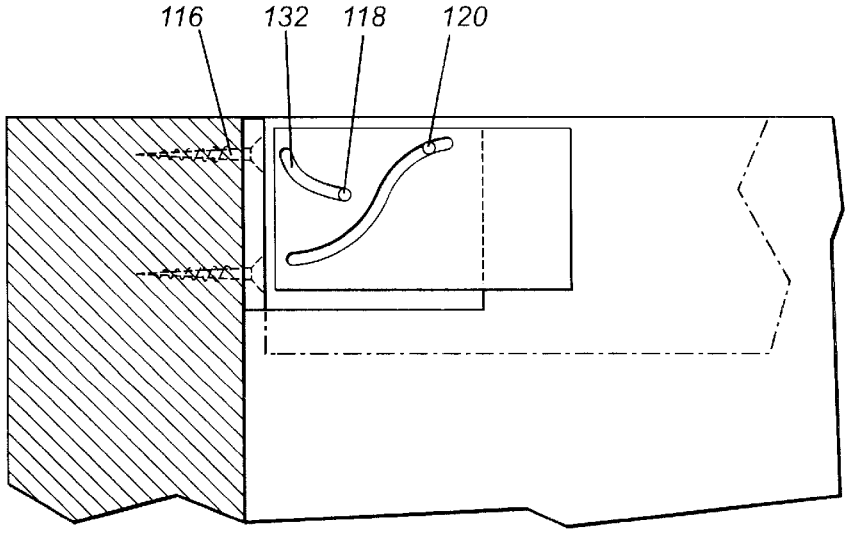
FIG. 6 is a top view, partially in section, illustrating the embodiment of FIG. 5 when the door is in a closed position.

In the arrangement of FIGS. 5 and 6, a slight modification of the hinge structure is shown. Similar reference numerals in the 100s are employed for similar components.

In this embodiment, first hinge member 114 has the bottom body portion similar to that of first hinge member 14. However, it also has an upwardly extending flange 150 which is secured to side frame member 110 by means of screws 116.

Figure 7:
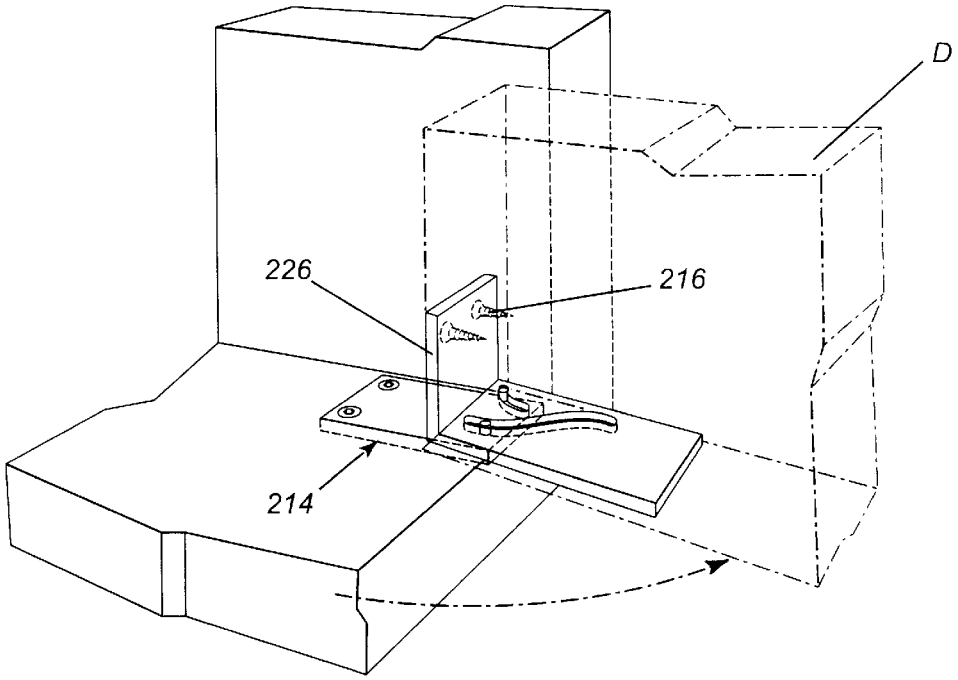
FIG. 7 is a perspective view similar to FIGS. 1 and 5 of a third embodiment of a hinge structure according to the present invention.
Figure 8:
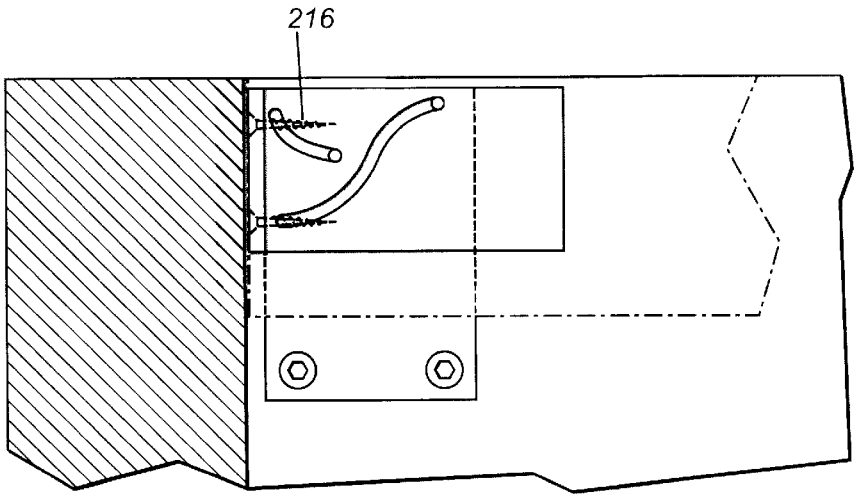
FIG. 8 is a top view, partially in section, of the embodiment of FIG. 7 when the door is in a closed position.
Figure 7A:
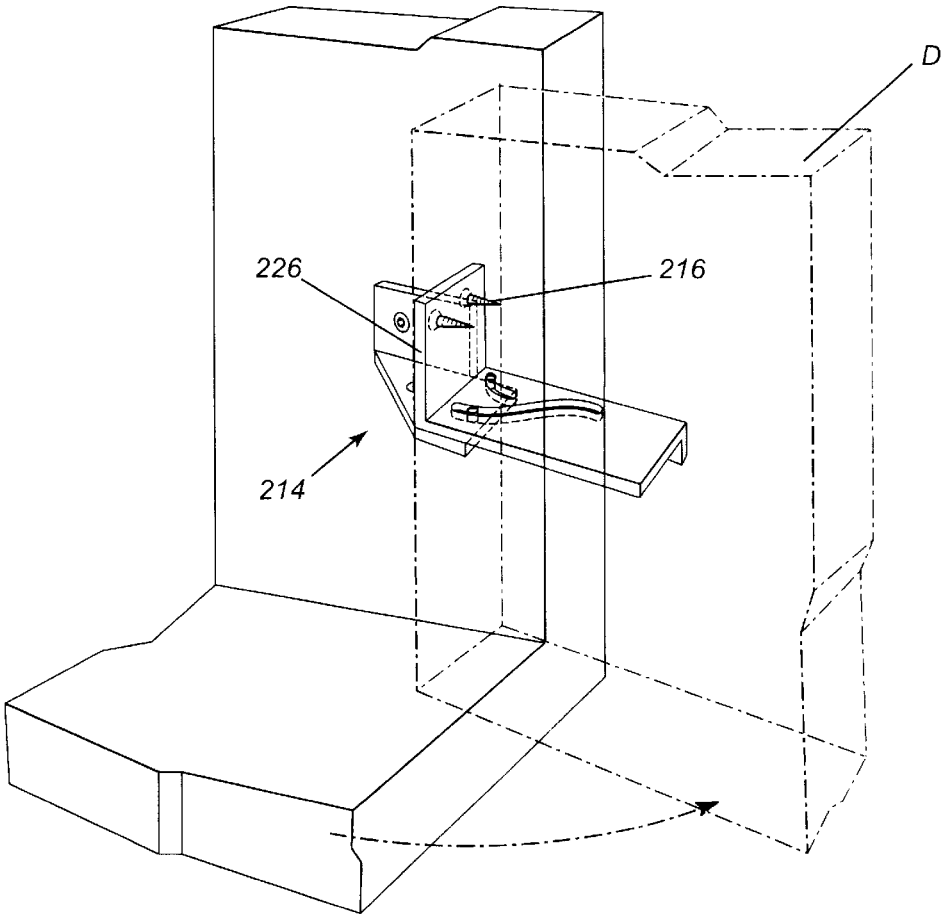
FIG. 7A is a perspective view of a modified arrangement of the embodiment of FIG. 7.

In the embodiment of FIGS. 7 and 8, reference numerals in the 200s are used to describe similar components. In this embodiment, second hinge member 224 has a vertical portion 226 which is secured to the inner end wall of door D instead of the side wall. In the arrangement shown in FIG. 7A, there will be seen that the hinge member can be mounted at a point other than at the top and bottom of the panel.

Figure 9:
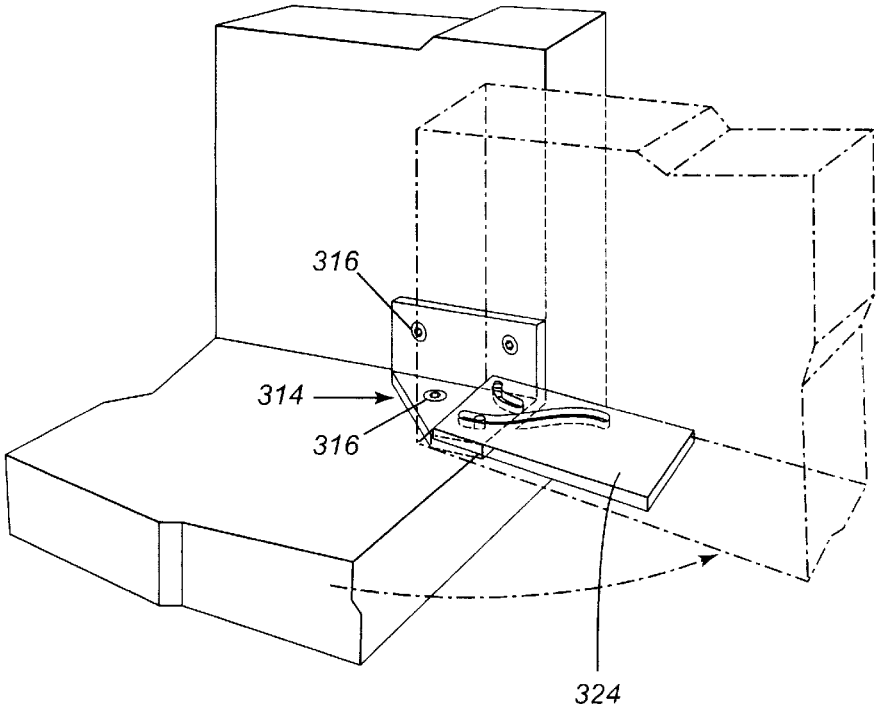
FIG. 9 is a perspective view similar to FIGS. 1, 5 and 7 of a fourth embodiment of a hinge structure according to the present invention.
Figure 10:
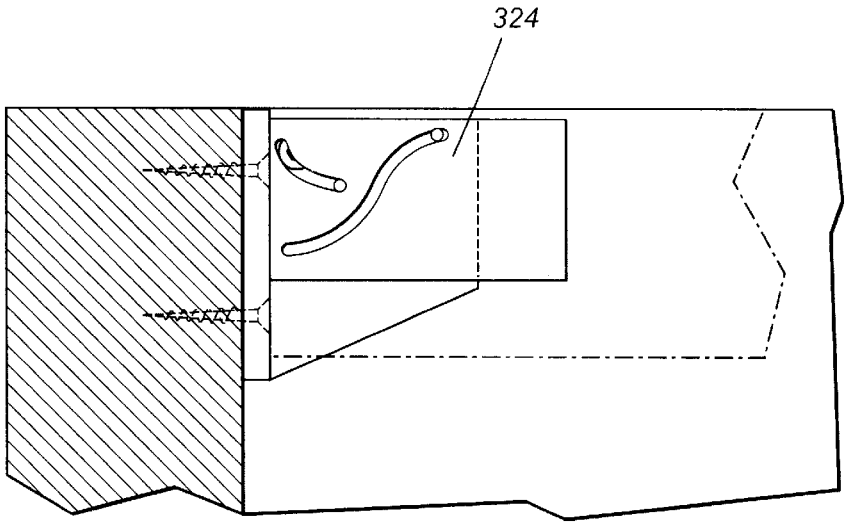
FIG. 10 is a top view, partially in section, of the embodiment of FIG. 9 when the door is a closed position.

In the embodiment of FIGS. 9 and 10, similar reference numerals in the 300s are employed. In this embodiment, second hinge member 324 is recessed within the bottom of door D while first hinge member 314 is secured to both side frame member 310 and bottom frame member 312 by means of screws 316.

It will be understood that the above described embodiments are for purposes of illustration only and that changes or modifications may be made thereto without departing from the spirit and scope of the invention.

I claim:

1. A hinge structure comprising:

a first member having first and second pins extending upwardly therefrom;

a second member, said second member having first and second slots designed to receive said first and second pins respectively, said first slot having an arcuate configuration to permit said first pin to move therein, said second slot having an elongated S-shaped configuration having a first arcuate portion thereof extending in a first direction and a second arcuate portion thereof extending in a second arcuate direction, said hinge structure further including a spring member situated proximate one end of said second slot, said spring member biasing said second pin towards said one end of said second slot.

2. The hinge structure of claim 1 wherein said first member is secured to a frame structure and said second member is secured to a swingable panel.

3. The hinge structure of claim 3 wherein said first member is in the form of a plate secured to said frame structure.

4. The hinge structure of claim 3 wherein said second member has a flange extending upwardly therefrom for securement to said swingable panel.

5. The hinge structure of claim 2 wherein said second member is in the form of a plate secured to said swingable panel.

6. The hinge structure of claim 2 wherein said second member has a flange extending outwardly therefrom for securement to said swingable panel.

7. A hinge structure for use in securing a panel to a frame comprising:

a first member having first and second pins extending upwardly therefrom;

a second member, said second member having a substantially planar plate portion, said planar portion having a first marginal edge designed to be placed proximate an end wall of said panel;

first and second slots formed in said plate portion, said first and second slots being designed to receive said first and second pins respectively, said first slot having an arcuate generally C-shaped configuration to permit said first pin to move therein, said first slot having a first end proximate said first marginal edge of said plate portion, said second slot having an elongated S-shaped configuration, a first end of said second slot being located proximate said first marginal edge of said plate portion, said second slot having a greater length than said first slot.

8. In structure of claim 7 wherein said second member has a flange extending outwardly therefrom for securement to said panel.

9. A structure comprising a frame and a panel, a hinge structure hingedly connecting said panel to said frame, said hinge structure comprising:

a first member having first and second pins extending upwardly therefrom, said first member being secured to said frame;

a second member, said second member being secured to said panel, said second member having first and second slots designed to receive said first and second pins respectively, said first slot having an arcuate configuration to permit said first pin to move therein, said second slot having an elongated S-shaped configuration; and the arrangement being such that when said panel is in a closed position adjacent said frame and a force is exerted thereon to open said panel, the initial opening of said panel is guided by relative movement between said first pin and said second pin to create a shifting motion of said panel with respect to said frame, and subsequent opening movement is guided by movement between said second pin and said second slot to permit full opening of the panel.

10. The structure of claim 9 wherein said panel is rectangular and said frame extends thereabout, said panel being set flush with said frame.

11. The structure of claim 9 wherein said panel comprises a cupboard door.

* * * * *